US010788285B2

(12) United States Patent
Engelstein et al.

(10) Patent No.: US 10,788,285 B2
(45) Date of Patent: Sep. 29, 2020

(54) DRY-FIRE MAGAZINE

(71) Applicants: Tal Engelstein, Ramat Gan (IL); Amir Bilu, Herzliya (IL)

(72) Inventors: Tal Engelstein, Ramat Gan (IL); Amir Bilu, Herzliya (IL)

(73) Assignees: Tal Engelstein, Ramat Gan (IL); Amir Bilu, Herzliya (IL)

( * ) Notice: Subject to any disclaimer, the term of this patent is extended or adjusted under 35 U.S.C. 154(b) by 0 days.

(21) Appl. No.: 16/209,431

(22) Filed: Dec. 4, 2018

(65) Prior Publication Data

US 2019/0170470 A1 Jun. 6, 2019

(30) Foreign Application Priority Data

Dec. 5, 2017 (IL) ..... 256117

(51) Int. Cl.

| | |
|---|---|
| ***F41A 33/00*** | (2006.01) |
| ***F41A 17/34*** | (2006.01) |
| ***F41A 9/64*** | (2006.01) |
| ***F41A 17/06*** | (2006.01) |
| ***F41A 33/02*** | (2006.01) |

(52) U.S. Cl.
CPC ..... *F41A 33/00* (2013.01); *F41A 9/64* (2013.01); *F41A 17/063* (2013.01); *F41A 17/34* (2013.01); *F41A 33/02* (2013.01)

(58) Field of Classification Search
CPC ..... F41A 33/00; F41A 33/02; F41A 17/34; F41A 9/64
USPC ..... 42/70.02
See application file for complete search history.

(56) References Cited

U.S. PATENT DOCUMENTS

| | | | | |
|---|---|---|---|---|
| 5,993,215 | A | 11/1999 | Kotsiopoulos et al. | |
| 8,646,201 | B2 | 2/2014 | Hughes et al. | |
| 8,777,620 | B1 * | 7/2014 | Baxter | F41A 33/00 434/16 |
| 9,151,565 | B2 | 10/2015 | Peterson | |
| 9,182,189 | B2 | 11/2015 | Seigler | |
| 2007/0122770 | A1 | 5/2007 | Swensen | |
| 2011/0111374 | A1 | 5/2011 | Charles et al. | |
| 2015/0013201 | A1 | 1/2015 | Hannan et al. | |
| 2016/0169608 | A1 * | 6/2016 | Schulz | F41A 33/02 434/22 |
| 2016/0231087 | A1 * | 8/2016 | Dvorkin | F41G 3/2605 |
| 2016/0252326 | A1 | 9/2016 | Jones et al. | |
| 2017/0082390 | A1 * | 3/2017 | Morgan | F41A 33/00 |
| 2017/0248383 | A1 | 8/2017 | McLean | |

FOREIGN PATENT DOCUMENTS

| | | | |
|---|---|---|---|
| WO | WO-2005086592 A2 * | 9/2005 | F41A 33/00 |

* cited by examiner

*Primary Examiner* — Stephen Johnson
(74) *Attorney, Agent, or Firm* — M&B IP Analysts, LLC

(57) ABSTRACT

A dry-fire magazine for use with a firearm is disclosed. The dry-fire magazine includes a controller and a plurality of sensors connected to the controller. The dry-fire magazine uses the plurality of sensors for collecting data associated with one or more operations of the firearm and thereafter the data is transmitted, using a communication unit embedded within the controller, to an end-point device such as a smartphone.

9 Claims, 6 Drawing Sheets

DRY-FIRE MAGAZINE

CROSS-REFERENCE TO RELATED APPLICATIONS

This application claims priority under 35 U.S.C. 119 to Israel Application No. 256117, filed Dec. 5, 2017, now pending.

TECHNICAL FIELD

The present disclosure generally relates to firearms, and more specifically to dry-fire magazine for use with a firearm.

BACKGROUND

Dry-fire practice involves manipulating and using the weapon without loading the weapon with live ammunition. Typically, dry-fire practices are performed to simulate actual firing of the firearm when there is no suitable place to practice with live ammunition. As such dry-fire practices save time and money as there is no need to use expensive ammunition.

Dry-fire practice are a versatile and safe way to practice with firearms and improve shooting skills. There are several systems by which dry-fire practice can be performed. However, one major disadvantage of such systems is that these systems require to change the properties of the firearm (e.g., weight and shape). As a result, the practicing using such systems is no realistic.

Several systems exist today that allow users to capture motion and analyze the motion. These systems typically include video-based, wearable sensor-based or wireless sensor-based approaches. In the case of video capture, the user should have a video camera equipment setup in the location where the user wishes to use the equipment. In the case of wearable sensors, the sensors provide positional data that must be analyzed by a professional or otherwise skilled analyst to provide valuable feedback to the user. Furthermore, the wearable sensors are unable to be located in a precisely reproducible position with respect to the body of the user, thus introducing variability in the measured positions. These systems have limitations due to available equipment, performance constraints, and the need for human interpretation of gathered data.

Another known system, disclosed in the related art includes, an illuminator for emitting, upon receiving a command from a controller, a beam of visible or invisible illumination from the barrel of the firearm, the beam being parallel to its central axis. The illuminator provides indication of a virtual point of impact, however the indication is a light that terminates rapidly. Therefore, it is difficult to identify the virtual point of impact and to improve the user's shooting skills.

It would therefore be advantageous to provide a solution that would overcome the deficiencies noted above.

BRIEF DESCRIPTION OF THE DRAWINGS

The subject matter that is regarded as the disclosure is particularly pointed out and distinctly claimed in the claims at the conclusion of the specification. The foregoing and other objects, features and advantages of the disclosure will be apparent from the following detailed description taken in conjunction with the accompanying drawings.

DETAILED DESCRIPTION

Figure 1A:
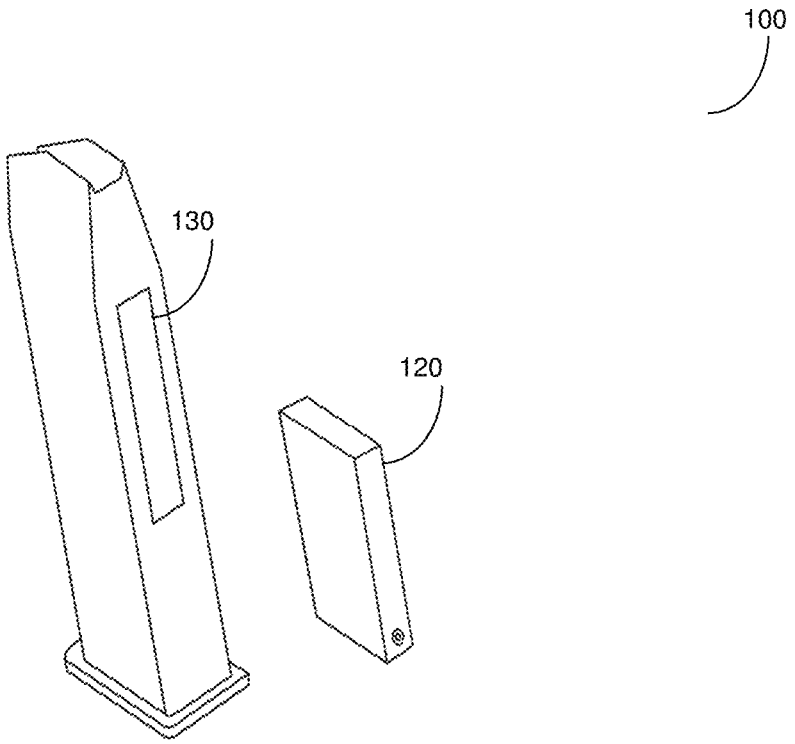
FIG. 1A is an exploded view of a dry-fire magazine for use with a firearm according to an embodiment.

The embodiments disclosed by the disclosure are only examples of the many possible advantageous uses and implementations of the innovative teachings presented herein. In general, statements made in the specification of the present application do not necessarily limit any of the various claimed disclosures. Moreover, some statements may apply to some inventive features but not to others. In general, unless otherwise indicated, singular elements may be in plural and vice versa with no loss of generality. In the drawings, like numerals refer to like parts through several views.

In an example embodiment, a dry-fire magazine for use with a firearm is provided. Dry-fire magazine is a contraption having the shape of a traditional magazine of a firearm although it does not include the same mechanical components such as a traditional magazine that allow the magazine to store and release bullets based on the firearm operation. The dry-fire magazine includes a controller and a plurality of sensors connected to the controller. The dry-fire magazine uses the plurality of sensors for collecting data associated with one or more operations of the firearm and thereafter the data is transmitted, using a communication circuit embedded within the smart module, to an end-point device such as a smartphone.

FIG. 1A shows an example schematic front view of a dry-fire magazine 100 for use with a firearm according to an embodiment. The dry-fire magazine 100 may be designed in several ways and may have similar elements, such as traditional magazines of different kinds of known firearms, such as, Glock®, Sig Sauer®, M-16, AK-47, and the like.

In an embodiment, the dry-fire magazine 100 is designed to fit standard firearms. Therefore, the dry-fire magazine 100 having similar elements, such as traditional magazines of traditional firearms for properly loading the dry-fire magazine 100 into a traditional firearm, locking the dry-fire magazine 100 within the firearm and removing the dry-fire magazine 100.

The dry-fire magazine 100 includes a controller 120 embedded within the dry-fire magazine 100. The controller 120 is a computing device integrating a hardware and software components, such as a microcontroller. The controller 120 includes a communication circuit (shown in FIG. 2) allowing to establish, for example, a wireless communication link between the dry-fire magazine 100 and an end-point device (shown in FIG. 4). The end-point device may be for example, a smartphone, a tablet computer, a personal computer (PC), a laptop computer, a wearable device, a designated electronic device, and the like.

The dry-fire magazine 100 further includes a plurality of sensors (shown in FIG. 2) embedded within the controller 120 and communicatively connected thereto. In an embodiment, the plurality of sensors are connected to the communication circuit (shown in FIG. 2). Each sensor is configured to collect data, i.e. sensory signals, associated with one or more operations of the firearm. Examples for a sensor may include a sound detection sensor, a motion detector, a proximity sensor, a temperature sensor, a touch detector, and the like. The operations of the firearm may include for example, drawing the firearm, pulling the trigger, changing magazines, and so on.

According to an embodiment, the sensory signals collected by the plurality of sensors are transmitted, via the communication circuit, to the end-point device for further processing. The end-point device, according to one embodiment, is configured to analyze the data and display the analyzed data on a display of the end-point device.

As an example, analysis of the sensory signals a may be indicative of the time elapsed from a starting point of a training session until the first time the trigger was pulled. According to the same example, a sound detection sensor may be used to identify a knocking sound of a trigger break. The analysis may include, for example, comparing the identified sound to predefined sounds of trigger breaks in order to determine whether the trigger break collected is associated with the firearm at which the dry-fire magazine 100 is installed or whether the trigger break was made by a different firearm.

As another example, a motion sensor may be used to identify the user's movements when pulling out the firearm from a pouch, aiming the firearm towards a target, when pulling the trigger, and so on. The collected signals may indicate whether the user's movements are good enough, whether it needs more practice, which section of the practice requires more practicing, and so on.

In an embodiment, the analysis, performed by the end-point device, may include converting the collected signals to first type of data and comparing the first type of data to historical data corresponding to historical dry-fire practice sessions of the user. The first type of data may also be compared to second type of data corresponding to other users' dry-fire performances.

According to one embodiment, the dry-fire magazine 100 also includes a cavity 130 to which the controller 120 inserted. According to another embodiment, the controller 120 is removable module that can be pulled out of a first dry-fire magazine 100-1 and inserted into at least a second dry-fire magazine 100-2.

Figure 1B:
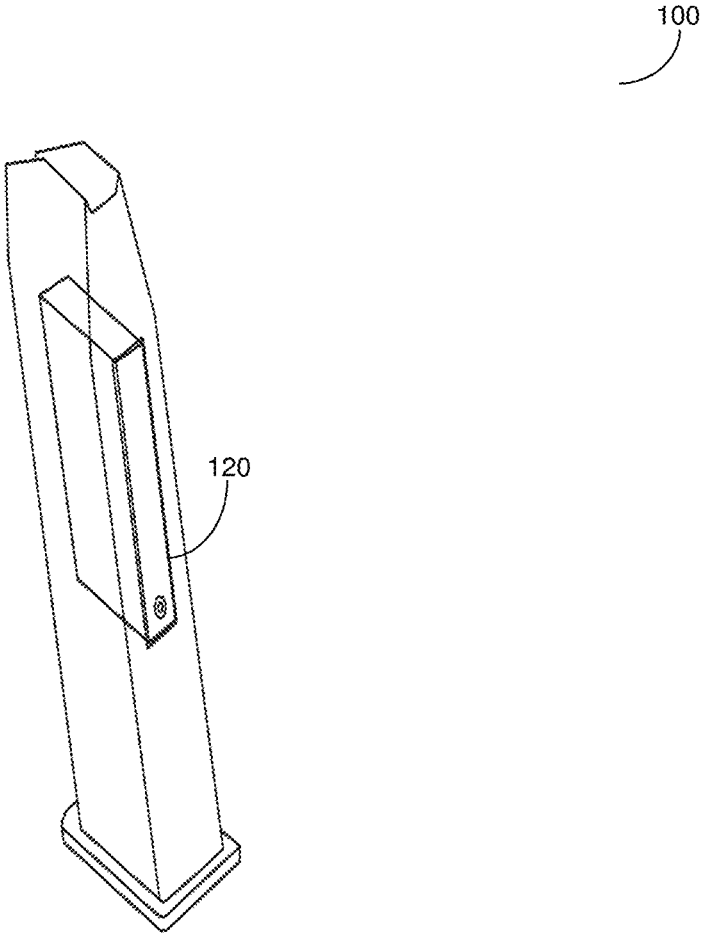
FIG. 1B is a front isometric view of a dry-fire magazine for use with a firearm according to an embodiment.

FIG. 1B is a front isometric view of a dry-fire magazine 100 for use with a firearm according to an embodiment. The controller 120 is positioned within the dry-fire magazine 100 through the cavity 130. According to one embodiment, the cavity 130 is located at the bottom side of the dry-fire magazine 100. In another embodiment, the dry-fire magazine 100 is located at the upper side of the dry-fire magazine 100.

According to yet another embodiment, the cavity 130 allows the controller 120 to be inserted into the dry-fire magazine 100 such that the controller 120 does not interrupt the insertion and the removal of the dry-fire magazine 100 from the firearm.

According to yet further embodiment, the dry-fire magazine 100 may weight like a traditional magazine in order to emulate the weight of a loaded traditional magazine. For example, if the weight of a Glock® full magazine is 170 grams, the dry-fire magazine 100 may be designed to have similar or identical weight in order to provide a realistic feeling.

Figure 2:
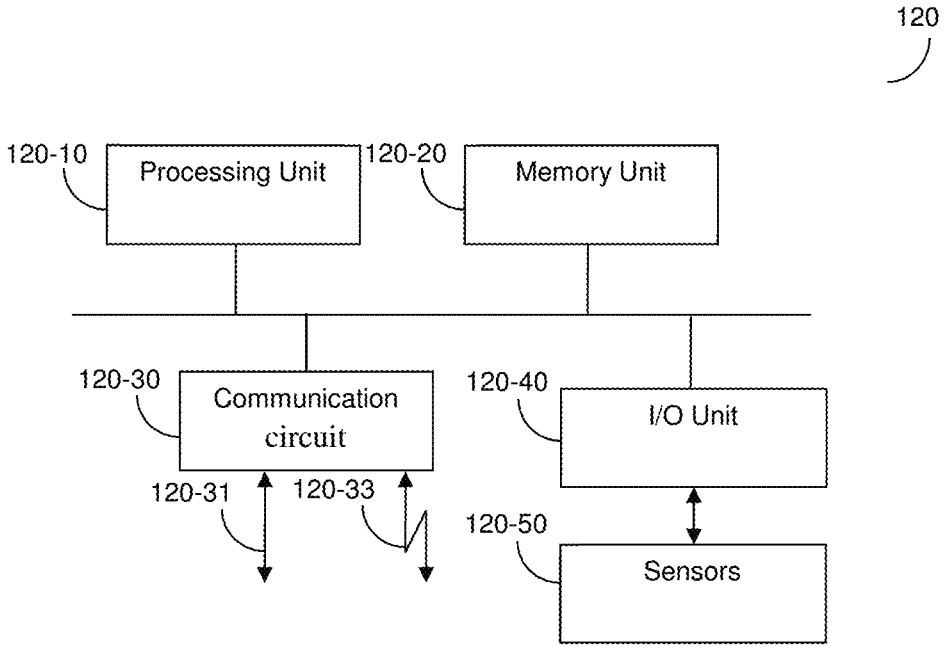
FIG. 2 is a schematic block diagram depicts the components of a smart module embedded within the dry-fire magazine according to an embodiment.

FIG. 2 is a schematic block diagram of the smart controller 120 structured according to an embodiment. The controller 120 is part of the dry-fire magazine 100. In an embodiment, the controller 120 includes a processing circuitry 120-10 and a memory 120-20. The controller 120 further comprises a communication circuit 120-30. The controller 120 may further comprise an input/output (I/O) unit 120-40.

The memory 120-20 may contain therein instructions that when executed by the processing unit 120-10 cause the processing unit 120-10 to execute actions, such as, managing the operation of the sensors.

The communication circuit 120-30 is configured to perform wired 120-31 and/or wireless 120-33 communication with external components such as a wired or wireless network, wired or wireless end-point devices using for example, such Wi-Fi, Bluetooth, BLE, radio frequency (RF), and so on.

The input/output (I/O) unit 120-40 may be utilized to control, for example, a plurality of sensors 120-50. A sensor 120-50 may be, for example but not by way of limitation, an environmental sensor, a camera, a microphone, a motion detector, a proximity sensor, a temperature sensor and a touch detector, configured to sense and identify real time data. The sensors 120-50 may be connected directly to the communication circuit 120-30. Alternatively, the sensors 120-50 may be communicatively connected to the processing unit 120-10 that allows collection of the data from the sensors 120-50.

Figure 3:
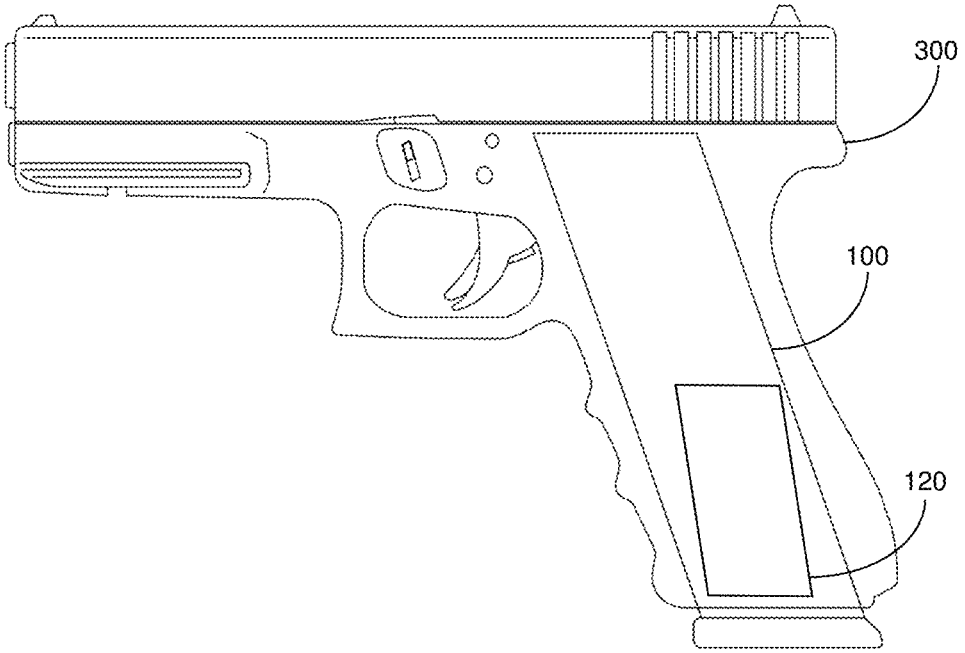
FIG. 3 is a side view of a dry-fire magazine positioned within a firearm.

FIG. 3 shows an example side view of a dry-fire magazine 100 positioned within a firearm 300, according to an embodiment. The firearm 300 shown in FIG. 3 is a certain type of a handgun. It should be noted to that the dry-fire magazine 100, containing therein the controller 120, may be adapted to multiple traditional firearms, such as, a handgun, a rifle, and so on.

Figure 4:
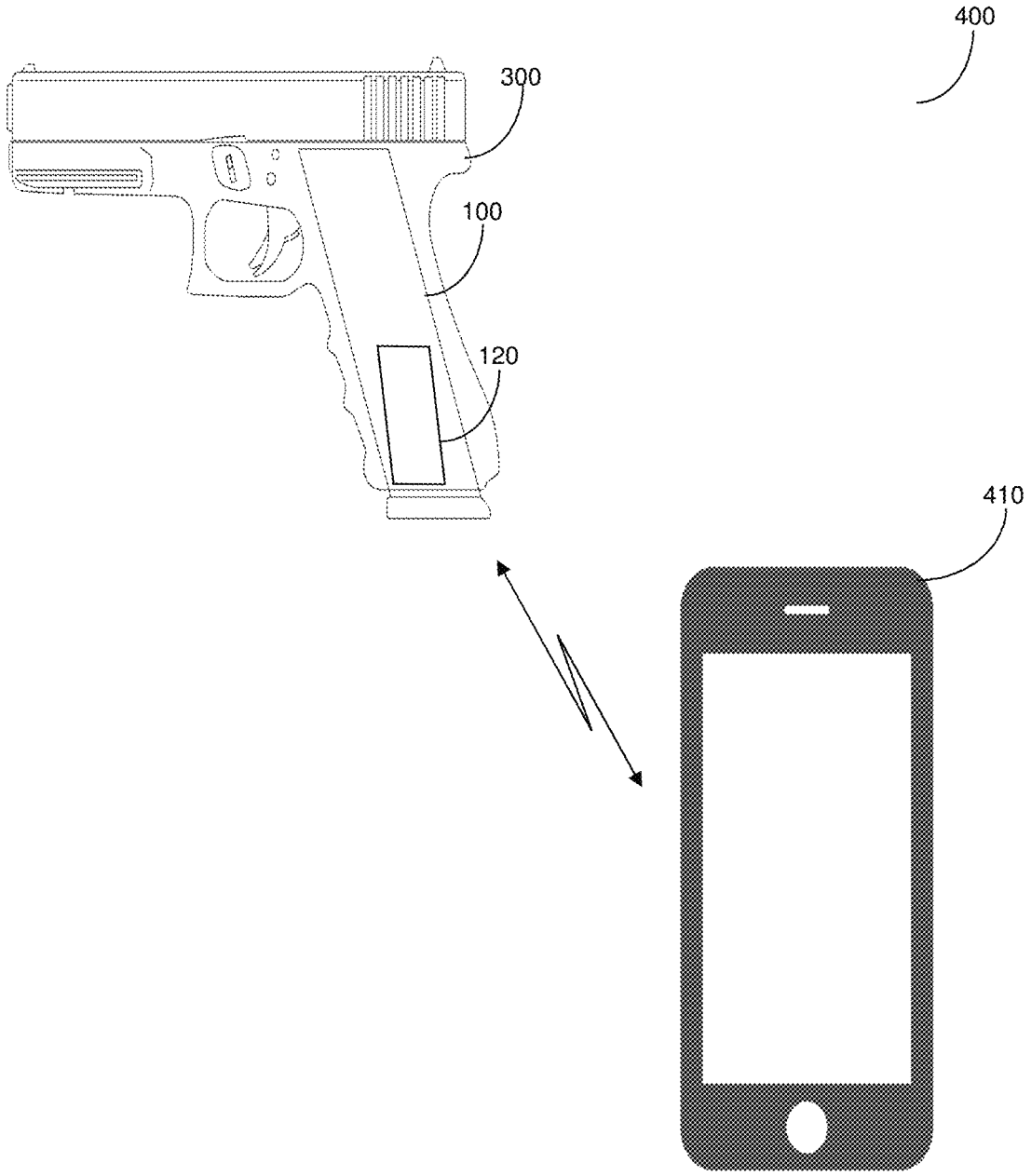
FIG. 4 is a schematic diagram of a dry-fire magazine, positioned within a firearm, adapted to communicate with an end-point device according to an embodiment.

FIG. 4 is an example schematic diagram of a dry-fire magazine 100, positioned within a firearm, configured to communicate with an end-point device according to an embodiment. As further described herein above, the dry-fire magazine 100 includes a controller 120 embedded within the dry-fire magazine 100.

The controller 120 uses the communication circuit (shown in FIG. 2) for establishing, for example, a wireless communication link between the controller 120 and an end-point device such as the EPD 410. The EPD 410 may be for example, a smartphone, tablet, personal computer (PC), laptop, wearable device, etc.

Upon establishment of such communication link, the data collected by the sensors may be sent to the EPD 140. The data, i.e. signals collected by the sensors, may include for example, movements of the firearm indicative of drawing the firearm, a direction to which the firearm was pointed, number of trigger breaks, intervals between trigger breaks, and so on.

Figure 5:
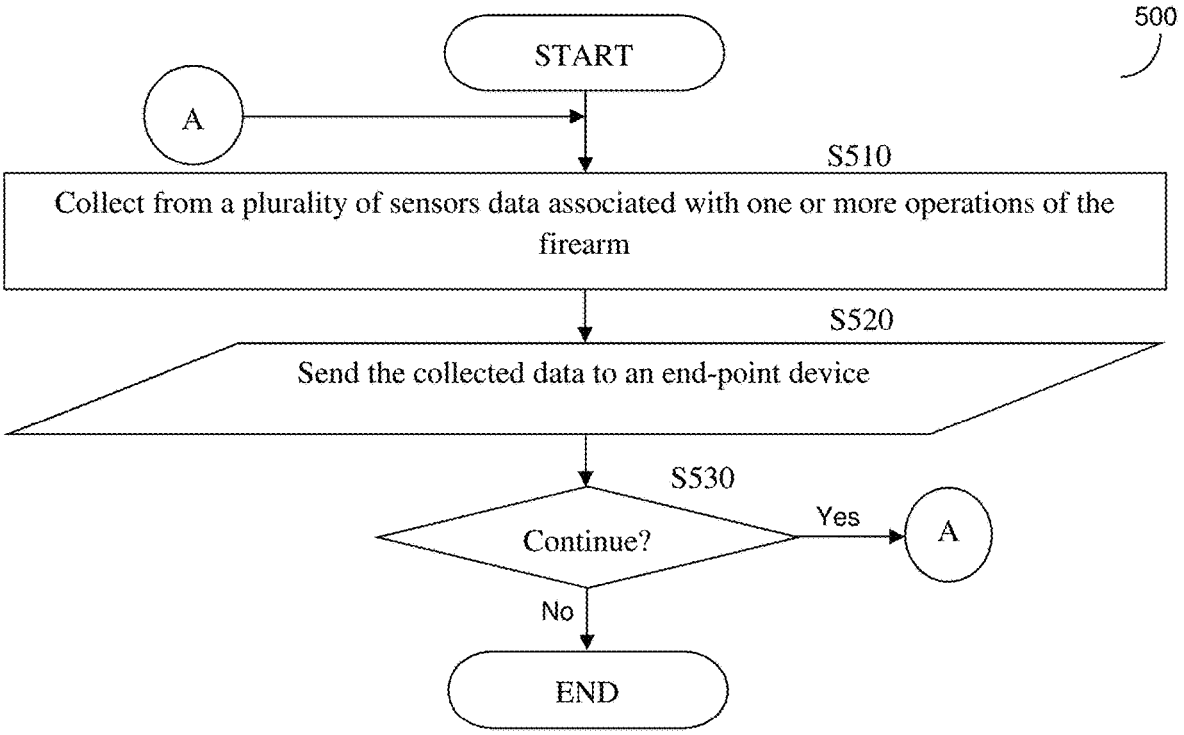
FIG. 5 depicts an exemplary and non-limiting method for using a dry-fire magazine according to an embodiment.

FIG. 5 depicts an example flowchart 500 illustrating a method for using a dry-fire magazine 100 according to an embodiment. At S510, sensory signals associated with one or more operations of the firearm are collected. The signal may be provided by the sensors embedded within the dry-fire magazine 100. In an embodiment, the sensory signals may be associated with metadata. The metadata may include the firearm's type, day and time, training session ID, and so on.

For example, a sensor, such as, a microphone may sense a certain sound that is indicative of a trigger break. Thereafter, exact time pointer at which the trigger break has occurred may be included as the metadata. The time pointer may be determined by another sensory, e.g., a timer.

At S520, the collected signals and metadata are sent to an end-point device. In an embodiment, S520 further includes establishing a communication link between the controller 120 and the end-point device. In an embodiment, the sensory signals are constantly collected during a training session.

In an embodiment, a trigger is received and initiates collection of data associated with one or more operations of the firearm. The trigger may be for example, identifying that the dry-fire magazine 100 was inserted into a firearm, identifying that the controller 120 was inserted into the dry-fire magazine 100, and so on. The trigger may be received using at least one of the plurality of sensors. S530 is an optional step, it is checked whether to continue the operation and if so, execution continues with S510; otherwise, execution terminates.

It should be appreciated that the controller, performing the method disclosed embodiment, allows monitoring how a user operates a firearm (e.g., shooting skills), while keeping the realistic elements of the firearm, the magazine, the scenarios, the scenes, etc. When the dry-fire magazine is inserted into the firearm, the dry-fire magazine allows to collect the data and transmit the data to an end-point device, such that the data may be analyzed and displayed.

According to yet further embodiment, the EPD 410 may be configured to receive the sensory signals, collected by the sensors, from the communication circuit 120-30. The sensory signals may be associated with metadata. The metadata may include the firearm's type, day and time, training session ID, and so on. The EPD 410 may be configured to analyze the sensory signals together with the metadata related thereto. The analysis may include comparing the sensory signals to historical sensory signals collected by the sensors of the controller 120. The historical sensory signals may be associated with other users' dry-fire practice sessions and may be extracted from a database, a cloud database, and so on. Upon analyzing the sensory signals and the metadata related thereto, the EPD 410 may be configured to display the results of the analysis, generate suggestions with respect of the results, save the results for further usage, and so on.

The various disclosed embodiments may be implemented as hardware, firmware, software, or any combination thereof. Moreover, the software is preferably implemented as an application program tangibly embodied on a program storage unit or computer readable medium. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

A person skilled-in-the-art will readily note that other embodiments of the disclosure may be achieved without departing from the scope of the disclosed disclosure. All such embodiments are included herein. The scope of the disclosure should be limited solely by the claims thereto.

What is claimed is:

1. A dry-fire magazine for use with a firearm, comprising:

a plurality of sensors configured to collect sensory signals indicative of an operation of the firearm; and a controller embedded within the dry-fire magazine, wherein the controller is configured to monitor the operation of the firearm based on sensory signals received from the plurality of sensors, and wherein the controller is removably received via a port in a lateral side of the dry-fire magazine.

2. The dry-fire magazine of claim 1, wherein the controller further comprises:

a communication circuit for communicating with an end-point device; and an input/output (I/O) unit configured to control the plurality of sensors.

3. The dry-fire magazine of claim 1, wherein the plurality of sensors includes at least one of: an environmental sensor, a camera, a microphone, a motion detector, a proximity sensor, a temperature sensor, and a touch detector.

4. The dry-fire magazine of claim 1, wherein the plurality of sensors is included in the controller.

5. The dry-fire magazine of claim 3, wherein the controller is further configured to:

receive a trigger for initiating collection of data associated with one or more operations of the firearm;

collect sensory signals associated with the one or more operations of the firearm; and, send the collected sensory signals to an end-point device.

6. The dry-fire magazine of claim 5, wherein the sensory signals are indicative of a trigger break.

7. The dry-fire magazine of claim 5, wherein the sensory signals are indicative of at least a motion of the firearm.

8. The dry-fire magazine of claim 1, wherein the controller is a removable unit.

9. The dry-fire magazine of claim 1, wherein the controller is designed to fit different types dry-fire magazines.

* * * * *